US011141621B2

(12) United States Patent
Kushner et al.

(10) Patent No.: US 11,141,621 B2
(45) Date of Patent: Oct. 12, 2021

(54) COMBINED FRICTION RESISTANCE AND ELASTIC RESISTANCE EXERCISE DEVICE

(71) Applicant: T2 FITNESS PRODUCTS, INC., Wellington, FL (US)

(72) Inventors: Stephen Kushner, Margate, FL (US); Louis Lara, Wellington, FL (US)

(73) Assignee: T2 Fitness Products, Inc., Wellington, FL (US)

( * ) Notice: Subject to any disclaimer, the term of this patent is extended or adjusted under 35 U.S.C. 154(b) by 2 days.

(21) Appl. No.: 16/806,399

(22) Filed: Mar. 2, 2020

(65) Prior Publication Data

US 2021/0268327 A1 Sep. 2, 2021

(51) Int. Cl.

| | |
|---|---|
| ***A63B 21/055*** | (2006.01) |
| ***A63B 21/00*** | (2006.01) |
| ***A63B 21/16*** | (2006.01) |
| ***A63B 21/018*** | (2006.01) |

(52) U.S. Cl.

CPC ..... *A63B 21/0555* (2013.01); *A63B 21/018* (2013.01); *A63B 21/0557* (2013.01); *A63B 21/16* (2013.01); *A63B 21/4035* (2015.10); *A63B 21/4043* (2015.10)

(58) Field of Classification Search

CPC . A63B 21/0555; A63B 21/4043; A63B 21/16; A63B 21/4035; A63B 21/0557; A63B 21/018; A63B 21/15–156; A63B 7/04–045; A63B 21/00043; A63B 21/012–02; A63B 21/055–0555

See application file for complete search history.

(56) References Cited

U.S. PATENT DOCUMENTS

| | | | | | |
|---|---|---|---|---|---|
| 210,281 | A * | 11/1878 | Weston | B66D 3/10 188/64 |
| 3,142,192 | A * | 7/1964 | Edberg | F16H 55/36 474/186 |
| 3,462,142 | A * | 8/1969 | Sterndale | A63B 21/018 482/120 |
| 3,532,189 | A * | 10/1970 | Wade | A63B 21/018 188/65.3 |
| 3,614,098 | A * | 10/1971 | Carr | A63B 21/018 482/120 |
| 3,851,874 | A * | 12/1974 | Wilkin | A63B 21/155 482/92 |

(Continued)

*Primary Examiner* — Andrew S Lo

(74) *Attorney, Agent, or Firm* — Laurence A. Greenberg; Werner H. Sterner; Ralph A. Locher

(57) ABSTRACT

A frictional exercise device includes a shell body to be attached to a stationary object, for instance a door, a door-jamb or a floor, either directly or via a resistance band. A core cylinder in the shell body has an arcuate friction surface. A non-elastic strap winds partially around the core cylinder and hugs the friction surface. When said strap is pulled at one end, a frictional force between the friction surface and the strap opposes a movement of the strap across said friction surface. The magnitude of the frictional force is proportional to a resistive force applied at the opposite end. The arcuate friction surface is formed with a depression and adjoining elevations. A counterbrake projects towards the depression in the friction surface and deflects the strap towards the depression to define an undulating course of the strap along the friction surface and the counterbrake.

8 Claims, 2 Drawing Sheets

(56) References Cited

U.S. PATENT DOCUMENTS 3,885,789 A * 5/1975 Deluty ..... A63B 21/018 482/120
4,010,948 A * 3/1977 Deluty ..... A63B 21/018 482/120
4,060,240 A * 11/1977 Dunston ..... A63B 21/1663 482/131
4,540,172 A * 9/1985 Evans ..... A63B 21/018 482/120
4,667,625 A * 5/1987 Malone ..... A01K 27/005 119/785
4,779,866 A * 10/1988 Marshall ..... A63B 21/16 482/116
5,158,519 A * 10/1992 Hughes ..... A63B 21/015 482/115
5,352,172 A * 10/1994 Suzaki ..... A63B 21/018 182/191
5,399,137 A 3/1995 Kushner
5,795,274 A * 8/1998 Kasbohm ..... A63B 21/015 482/115
6,029,777 A * 2/2000 Rogelja ..... A62B 1/14 182/193
6,113,564 A * 9/2000 McGuire ..... A61H 1/0229 482/131
6,612,972 B1 9/2003 Reichard
6,662,651 B1 * 12/2003 Roth ..... A61B 5/224 73/379.02
7,621,856 B1 * 11/2009 Keith ..... A01K 27/004 119/796
7,963,366 B2 * 6/2011 Christianson ..... A62B 1/14 182/5
7,976,445 B2 * 7/2011 Lalaoua ..... A63B 21/1654 482/129
8,043,197 B2 * 10/2011 Hetrick ..... A63B 21/018 482/91
8,083,653 B2 * 12/2011 Hetrick ..... A63B 21/1663 482/91
8,088,053 B2 * 1/2012 Whyatt ..... A63B 21/4017 482/143
8,403,818 B1 * 3/2013 Wilkinson ..... A63B 21/4043 482/121
9,326,908 B2 * 5/2016 Scott ..... A63B 21/154
9,421,413 B2 * 8/2016 Staten ..... A63B 21/4035
9,656,115 B2 * 5/2017 Young ..... A63B 21/068
9,764,177 B2 * 9/2017 Baudhuin ..... A63B 21/151
10,857,404 B2 * 12/2020 Small ..... A63B 21/169
2002/0022555 A1 * 2/2002 Nesci ..... A63B 21/0552 482/91
2002/0187884 A1 * 12/2002 McGrath ..... A63B 21/0552 482/121
2003/0223808 A1 * 12/2003 Kuo ..... A63B 21/1609 403/220
2004/0043873 A1 * 3/2004 Wilkinson ..... A63B 21/00061 482/54
2005/0148437 A1 * 7/2005 Ryan ..... A63B 21/4043 482/37
2005/0170937 A1 * 8/2005 van Straaten ..... A63B 21/1654 482/124
2006/0264302 A1 * 11/2006 Sjodin ..... A63B 21/1663 482/91
2009/0062087 A1 * 3/2009 Poppinga ..... A63B 21/0552 482/124
2009/0137370 A1 * 5/2009 Kushnir ..... A63B 21/00069 482/120
2010/0137112 A1 * 6/2010 Harker ..... B60P 7/0823 482/92
2011/0166003 A1 * 7/2011 Brice ..... A63B 21/00 482/131
2011/0287906 A1 * 11/2011 Morris ..... A63B 21/00069 482/102
2013/0005544 A1 1/2013 Butler et al.
2013/0116098 A1 * 5/2013 Lee ..... A63B 21/00043 482/121
2013/0157818 A1 * 6/2013 Lalaoua ..... A63B 23/035 482/123
2013/0313047 A1 * 11/2013 Chaumontet ..... A62B 35/00 182/241
2013/0316876 A1 * 11/2013 Publicover ..... A63B 5/11 482/27
2015/0090196 A1 * 4/2015 Fleming ..... B66D 1/7415 119/795
2015/0335924 A1 * 11/2015 Fuchs ..... A62B 1/10 182/5
2016/0045778 A1 * 2/2016 Dwork ..... A63B 23/1227 482/96
2016/0310767 A1 * 10/2016 Resch ..... A63B 69/0048
2017/0001055 A1 * 1/2017 Brown ..... A63B 29/02
2017/0157448 A1 * 6/2017 Shavell ..... A63B 23/1236
2018/0021602 A1 * 1/2018 Rogelja ..... A62B 1/14 188/65.2
2021/0069531 A1 * 3/2021 Katznelson ..... A62B 1/14

* cited by examiner

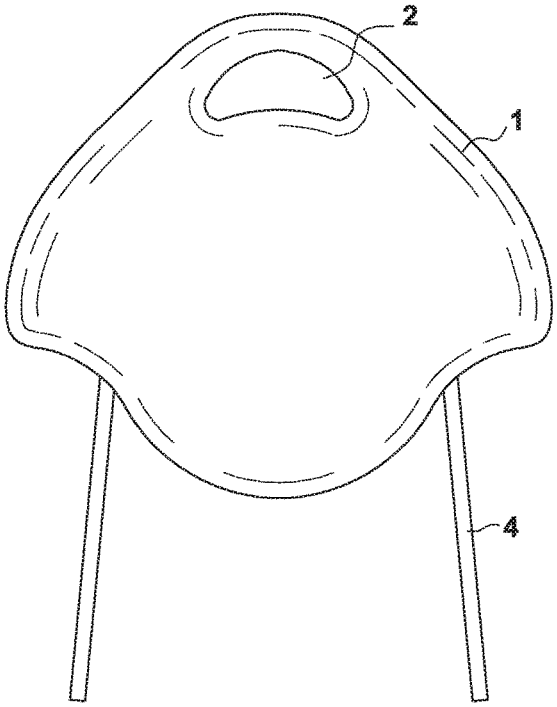
FIG. 5
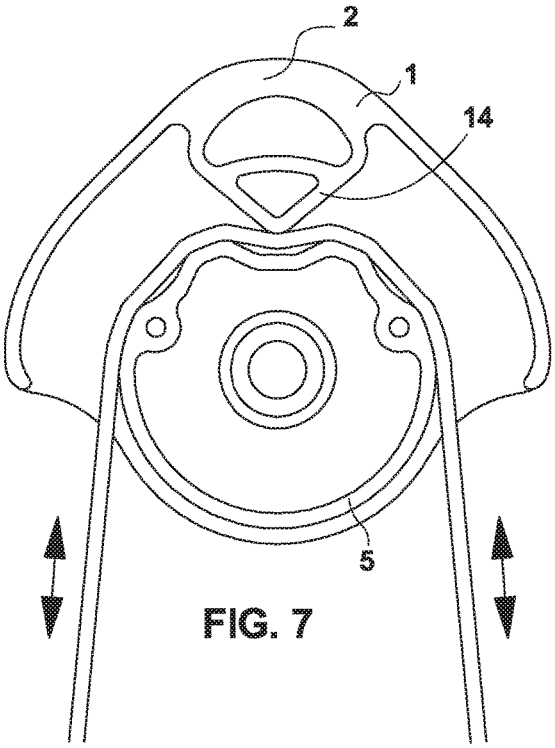
FIG. 7
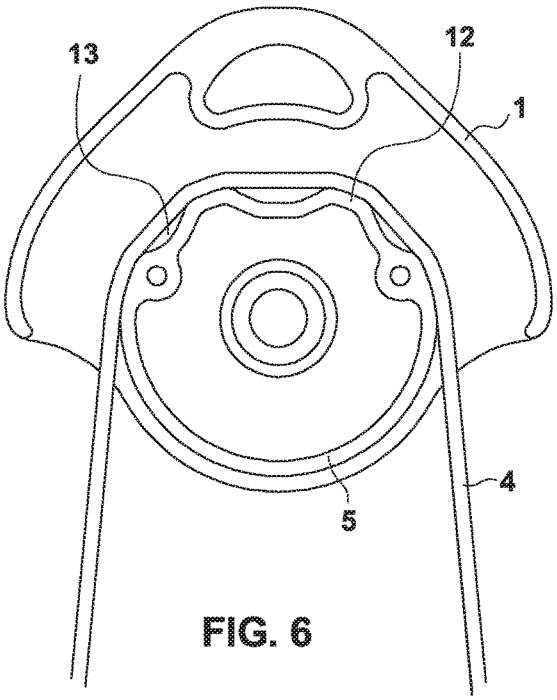
FIG. 6
FIG. 8
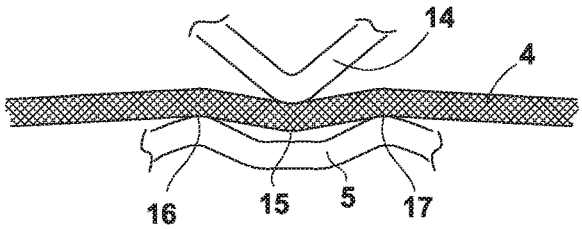

COMBINED FRICTION RESISTANCE AND ELASTIC RESISTANCE EXERCISE DEVICE

BACKGROUND OF THE INVENTION

Field of the Invention

The invention relates to an exercise device, more particularly a multi-purpose friction exercise device.

My earlier U.S. Pat. No. 5,399,137 describes an exercise device in which the force resistance is (primarily) provided by friction. Specifically, a strap is held at opposite ends by way of handles. As the strap is pulled at one handle, the strap moves across a friction surface. The disclosure of my earlier patent is herewith incorporated by reference. While there is provided a very versatile exercise device, certain features may be improved.

SUMMARY OF THE INVENTION

It is accordingly an object of the invention to provide an exercise device, which overcomes the hereinafore-mentioned disadvantages of the heretofore-known devices of this general type and which allows instantaneous and continuous adjustment thereof and which allows continuous transitions between warm-up, isometric and isokinetic exercises.

With the foregoing and other objects in view there is provided, in accordance with the invention, an exercise device, comprising:

a shell body configured for attachment to a substantially stationary object;

a core cylinder rigidly mounted to the shell body, the core cylinder having a wall with an arcuate friction surface;

a substantially elastic band extending between the shell body and the substantially stationary object;

a substantially non-elastic strap having a first end, a strap segment partially wound around the core cylinder and hugging the friction surface, and a second end opposite the first end, wherein, when the strap is pulled at the second end and a resistive force is applied at the first end, a frictional force between the friction surface and the strap opposes a movement of the strap across the friction surface, and wherein a magnitude of the frictional force is proportional to the resistive force applied at the first end; and the arcuate friction surface being formed with surface profiling for providing a resistive form-lock between the friction surface and the strap when the strap is being pulled at the second end.

In accordance with an added feature of the invention, the surface profiling includes resistance elements formed of bumps or raised projections on the friction surface, and/or grooves formed in the friction surface.

In accordance with an added feature of the invention, there is provided a counterbrake projecting towards a depression in the friction surface and deflecting the strap towards and into the depression. In a preferred embodiment, the friction surface is formed with elevations adjoining the depression, and the counterbrake and the elevations are disposed to force the strap along an undulating path along the friction surface.

The frictional force which results from the pulling force and from the resistive force, is virtually a function of the resistive force. In other words, the harder the strap is held back, the more resistance is added in terms of the frictional resistance on the arcuate surface (and the counterbrake). In the static limit, the pulling force equals the resistive force plus the friction (negligible forces such as gravity are not considered).

The invention is primarily based on the realization that frictional forces are most accurately adjusted in "real time", i.e. during the exercise and, furthermore, that the frictional resistance of the device should be a function of the applied force. Power input, therefore, is directly translated into opposing power output, with a small fraction "lost" to frictional heating of the device.

The device functions with a mechanical resistance wide band (strap) hugging or rubbing against a cylindrical fixed part. The resistance is an exchange between muscles, pitting one group of muscles against another with the addition of the frictional force. It is not necessary to adjust the device mechanically.

Kinesthetic exercises are preferred on the device, namely Combined Bilateral Contraction (C. B. C.) or combined activities exercises for legs and arms. By increasing the conscious C. B. C. force against the friction surface, the force placed on opposing muscles increases.

A slight increase in effort increases the resistance on the opposing muscles "exponentially". This allows for quick changes in intensity. Therefore, warm-up, isometrics and isokinetics can all be performed in one motion.

In accordance with an advantageous feature of the invention, the substantially non-elastic strap is a flat strap. The preferred band width of 1-1.5" allows all types of exercises.

In general application, warm-up, strength and power training can be done in a shorter time period than with any other training device. Workouts can be done in one third or even one fourth of the time.

Other features which are considered as characteristic for the invention are set forth in the appended claims.

Although the invention is illustrated and described herein as embodied in an exercise device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 5 is a view of the central resistance cylinder on a larger scale;

FIG. 6 is a broken-away view of the resistance device showing the main friction surface;

FIG. 7 is a similar view showing a preferred alternative of the friction resistance device; and FIG. 8 is a partial side view of an interior portion of the friction resistance device, on a slightly larger scale.

DETAILED DESCRIPTION OF THE INVENTION

Figure 1:
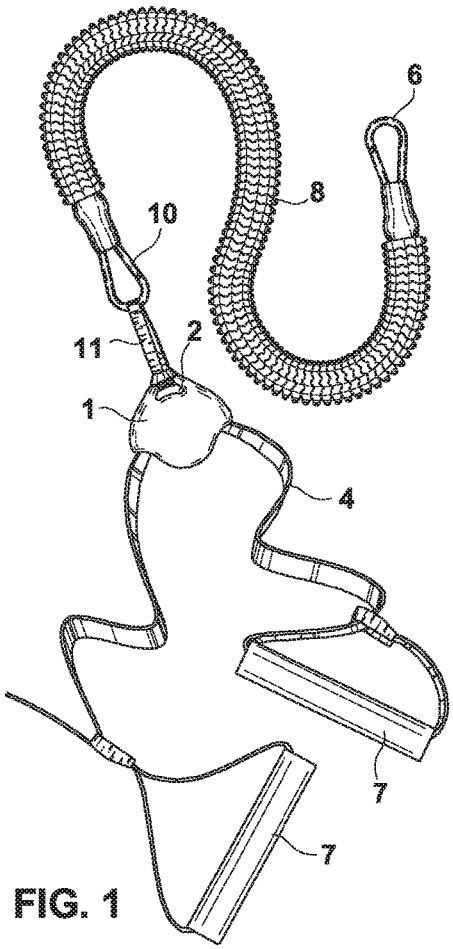
FIG. 1 is a partly perspective view of the exercise device according to the invention.
Figure 2:
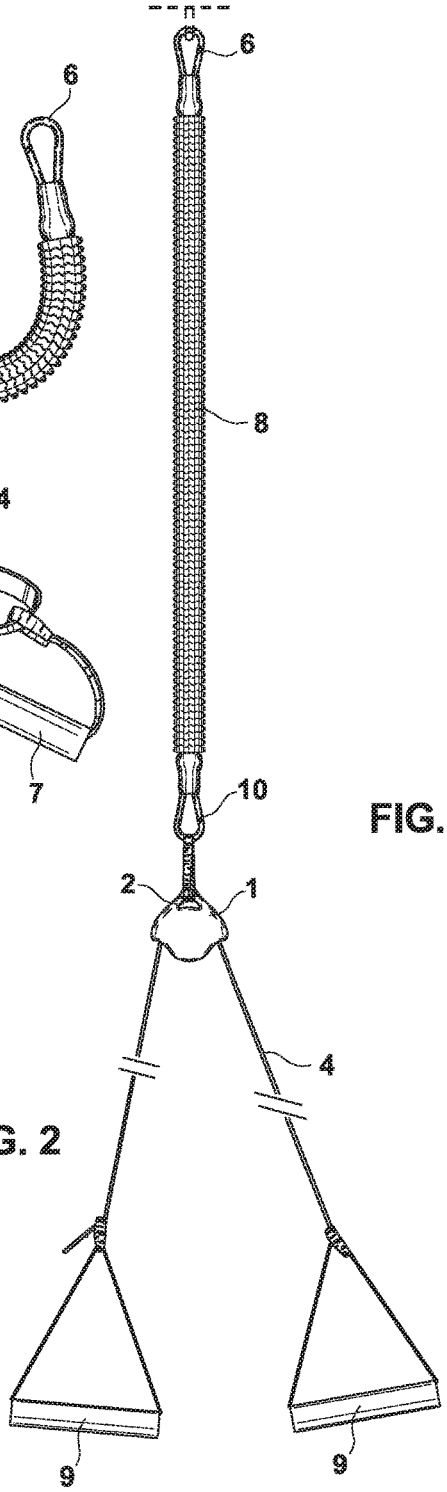
FIG. 2 is a side view of the device, shown suspended from an upper attachment hook.
Figure 3:
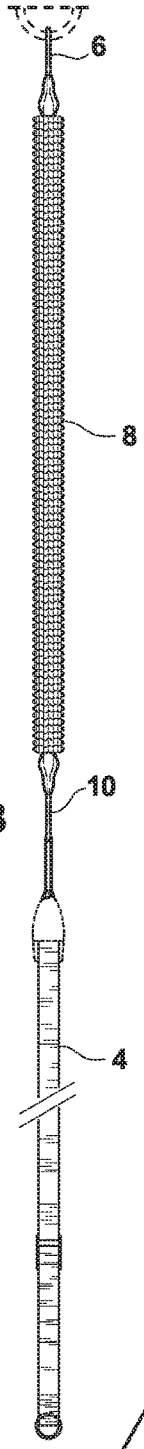
FIG. 3 is a side view of the device rotated by 90° about a vertical axis relative to FIG. 2.
Figure 4:
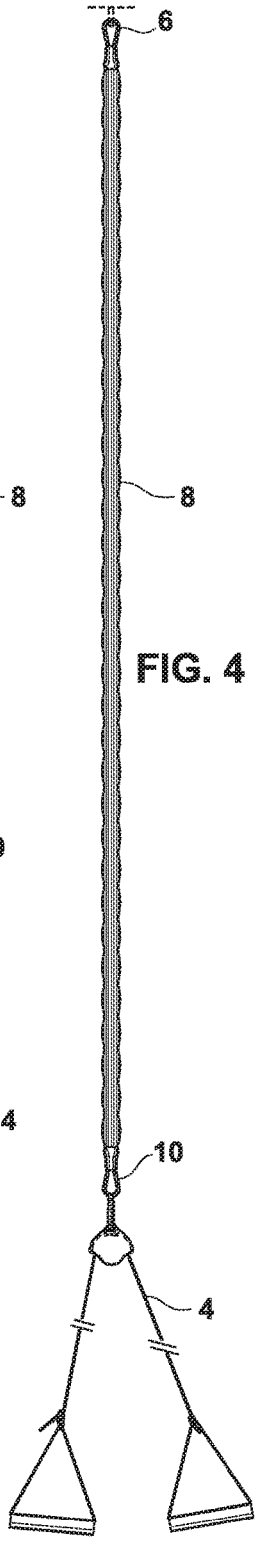
FIG. 4 is a view similar to FIG. 2 showing the elastic band portion stretched and expanded.

Referring now to the figures of the drawing, there is seen a shell body 1 with an attachment opening 2. The shell body 1 may be made out of plastic or metal, or a combination of the two. The shell body 1 is illustrated with a fully integrated attachment opening 2. In an alternative embodiment, the attachment opening may be formed as an external ring 2 that is welded to the shell body 1, for instance by way of fillet weld spots. The attachment ring 2 allows the shell body 1 to be attached to a stationary object. This includes rigidly holding the shell body 1 on the floor or in a corner, behind or on a door jamb, and the like. That is, the shell body 1 may be attached directly to a stationary body if pure friction resistance training is desired (see, U.S. Pat. No. 5,399,137) or it may be looped to a flexible, elastic band 5.

A flat strap or belt 4 extends through the shell body 1 and partially wraps around a core cylinder 5. See, FIGS. 6, 7. The core cylinder 5 is non-rotatably fixed in the shell body 1. It should be noted that the term "cylinder" is not necessarily used in the strict mathematical sense, but rather that any structure with a curved surface should be included in the definition. The core cylinder 5 may also be a partial cylinder. The proper functionality of the device is assured if an arcuate friction surface is provided. In the preferred embodiment, this is a cylindrical friction surface hugged by the strap 4 and upon which the strap 4 may slide.

The resistance line from a stationary connection at 6 to a set of handles 7 comprises three main segments, namely, a flexible elastic band 8, the shell body 1 with the core cylinder 5, and the strap 4, which is a flexible non-elastic band 4.

The terms elastic and non-elastic are relative, but not absolute, terms. The elastic band, for example, may be a conventional resistance band, a bungee cord, a rubber band, or the like. Such elastic bands are typically used in modern exercise context and they are readily available. The non-elastic strap or band is typically a fabric strap formed of synthetic fibers. The non-elastic strap is a material similar to a seatbelt and as such, it has a coefficient of longitudinal expansion, without tearing, of less than 5% or less than 3% or even less than 1%.

A connector 6, shown here as a carabiner hook 6, may be locked at any stationary attachment. This may be at a wall, on a door jamb, on a door, on an exercise frame, or the like. The elastic band 8 contains a core of one or more elastic resistance bands that are encased in a fabric sleeve or skirt.

The opposite end of the elastic band 8 is also shown with a carabiner hook 10, which connects to the core cylinder 5, either directly by snapping into the ring opening 2 or by way of an attachment strap 11. The strap 11 may be a simple hook-and-loop type band.

The band 4, which loops around the resistance surface on the core cylinder 5, has handles 9 at each of its free ends. In addition, the band 4 is length-adjustable at one or both of its free ends. The band 4, as illustrated, is a flat fabric belt, but it may also be a rope. It is generally non-elastic, except for a typical longitudinal flexibility provided by fabric belts. As will become clear from the following, the primarily important feature is the surface structure of the band 4 and its interaction with the friction surface on the core cylinder 5.

The core cylinder 5 and the strap 4 define an essential structural and functional feature of the invention. The core cylinder 5 is preferably formed of metal or of a plastic core with a metallic cylinder surface. The strap 4 is made of fabric, preferably of synthetic fiber material similar to seatbelt material. The surface structure of the core cylinder 5 and the material of the flat strap 4 are chosen such that (a) only a small amount of resistance is provided when the strap 4 is pulled on one end and no counter force is applied at the other end and that (b) a great amount of resistance is provided when a strong counter force is applied to the other end. In fact, it has been found in experiments with the preferred embodiment that an increase in the "resistance force" is greater than the increase in the "pulling force". The resistance force, thereby, is defined as the arithmetic sum of the counter force applied by the (resistive) arm and the frictional force. The pulling force is equal to the force applied by the pulling arm. In the extreme, therefore, the resistive arm can easily stop the strap, because it is aided by the frictional resistance between the strap 4 and the cylinder 5.

Due to the considerable "rubbing" between the strap 4 and the friction surface, the core cylinder 5 heats up and, furthermore, the strap 4 is subject to wear. Friction, in general terms, is a physical conversion of a force to heat. In some situations, therefore, the shell body 1 and the core cylinder 2 may heat up to such a degree that the shell body 1 becomes hot, and even too hot to touch. In order to avoid such extraneous heating and to provide effective resistance against the movement of the strap 4 on the friction surface of the core cylinder 2, the friction surface is provided with surface profiling, such as resistance elements 12, for example bumps or raised projections on the cylindrical surface, and/or grooves 13 formed in the surface. See, also U.S. Pat. No. 5,399,137. While these reduce the amount of heat generation, they lead to chafing and abrasive wear of the strap 4.

In order to further improve the resistance behavior of the device, there is provided, in accordance with an advantageous implementation, a counterbrake 14 which becomes increasingly effective the greater the pulling force is. The principle is illustrated in FIG. 8. Here, the movement of the strap 4 is not only opposed by the resistance provided by the opposite hand and the frictional force provided by the friction surface on the core cylinder 2, but also by the counterbrake 14. The counterbrake 14 of the illustration is a "nose" or a knuckle which dives into a depression 15 formed in the friction surface of the core cylinder 2. The strap 4 thus follows an undulating course along the counterbrake 14 and two raised elevations, or shoulders 16, 17 that adjoin the depression 15.

The ends of the flat strap 4 may be provided with the handles 9 or any other attachment means. Due to the versatility of the device, it is possible to attach a handle (usably with hands or with feet) on the one end and a strap loop on the other end. The strap loop may, for instance, be attached around the waist, the ring 2 may be hooked in a rod on which the person stands, and the handle 9 may be grasped with both hands. In that configuration it would be possible to perform squat/curl exercises or front raise/upright row/curl exercises. In another configuration, it is possible to attach the loop to one ankle, while the ring 2 is attached, say, under a door. Combined leg, hip and arm exercises are thus possible. Any number of exercises and configurations are possible with the claimed device, as they will be obvious to the person skilled in the exercise arts.

The combination of the non-elastic strap 4 with the elastic strap 8 provides a considerable amount of additional versatility.

The invention claimed is:

1. An exercise device, comprising:

a shell body configured for attachment to a substantially stationary object;

a core cylinder rigidly mounted to said shell body, said core cylinder having a wall with an arcuate friction surface;

a substantially elastic band extending between said shell body and the substantially stationary object;

a substantially non-elastic strap having a first end, a strap segment partially wound around said core cylinder and hugging said friction surface, and a second end opposite said first end, wherein, when said strap is pulled at said second end and a resistive force is applied at said first end, a frictional force between said friction surface and said strap opposes a movement of said strap across said friction surface, and wherein a magnitude of the frictional force is proportional to the resistive force applied at said first end;

said arcuate friction surface being formed with surface profiling for providing a resistive form-lock between said friction surface and said strap when said strap is being pulled at said second end; and a counterbrake projecting towards a depression in said friction surface and deflecting said strap towards and into said depression to provide an additional frictional force opposing the movement of said strap through said shell body.

2. The exercise device according to claim 1, wherein said substantially non-elastic strap is a flat strap.

3. The exercise device according to claim 1, wherein said surface profiling includes resistance elements formed of bumps or raised projections on said friction surface, and/or grooves formed in said friction surface.

4. The exercise device according to claim 1, wherein said friction surface is formed with elevations adjoining said depression, and said counterbrake and said elevations are disposed to force said strap along an undulating path along said friction surface.

5. An exercise device, comprising:

a shell body configured for attachment to a substantially stationary object;

a core cylinder rigidly mounted to said shell body, said core cylinder having a wall with an arcuate friction surface;

a substantially non-elastic strap having a first end, a strap segment partially wound around said core cylinder and hugging said friction surface, and a second end opposite said first end, wherein, when said strap is pulled at said second end and a resistive force is applied at said first end, a frictional force between said friction surface and said strap opposes a movement of said strap across said friction surface;

said arcuate friction surface being formed with surface profiling for providing a resistive form-lock between said friction surface and said strap when said strap is being pulled at said second end;

said arcuate friction surface being formed with a depression and elevations adjoining said depression; and a counterbrake projecting towards said depression in said friction surface and deflecting said strap towards and into said depression to define an undulating course of said strap along said friction surface and said counterbrake, and to provide an additional frictional force opposing the movement of said strap through said shell body;

wherein a total frictional force opposing the movement of said strap through said shell body is defined by the friction between said strap and said friction surface and the additional friction between said strap and said counterbrake, and wherein a magnitude of the total frictional force is proportional to the resistive force applied at said first end.

6. The exercise device according to claim 5, further comprising a substantially elastic band extending between said shell body and the substantially stationary object and flexibly and elastically connecting said shell body to the substantially stationary object.

7. The exercise device according to claim 5, wherein said substantially non-elastic strap is a flat strap.

8. The exercise device according to claim 5, wherein said surface profiling includes resistance elements formed of bumps or raised projections on said friction surface, and/or grooves formed in said friction surface.

* * * * *